United States Patent [19]

Ware et al.

[11] 4,361,183

[45] Nov. 30, 1982

[54] RECUPERATOR DESIGN

[75] Inventors: Jay T. Ware; Wayne S. Counterman; Milton C. Brown, all of Wellsville, N.Y.

[73] Assignee: Combustion Engineering, Inc., Windsor, Conn.

[21] Appl. No.: 170,380

[22] Filed: Jul. 21, 1980

[51] Int. Cl.[3] ..... F28F 7/00

[52] U.S. Cl. ..... 165/82; 165/142

[58] Field of Search ..... 165/70, 71, 81–83, 165/140–145; 122/DIG. 1, DIG. 2; 237/55; 432/143

[56] References Cited

U.S. PATENT DOCUMENTS 2,332,450 10/1943 Mantle ..... 165/142 X 2,475,025 7/1949 Huff ..... 165/140 X 3,973,621 8/1976 Bow et al. ..... 165/83

*Primary Examiner*—William R. Cline

*Assistant Examiner*—Theophil W. Streule, Jr.

*Attorney, Agent, or Firm*—William W. Habelt

[57] ABSTRACT

A structural support for a module of a concentric tube type recuperative heat exchanger. A plurality of support beams 18 extend laterally across each module to support upper and lower tube sheets 22–24 independent from surrounding housing structure. The support beams are attached to the tube sheets by pivotal hangers 26 that permit relative movement therebetween, while said support beams are themselves supported at their ends on lateral shelf units affixed to the housing that surrounds each module.

5 Claims, 3 Drawing Figures

RECUPERATOR DESIGN

BACKGROUND OF THE INVENTION

1. Field of the Invention

This invention relates to a structural arrangement for a concentric tube heat exchanger and particularly it relates to a unique support for a modular tube type heat exchanger wherein a heating fluid flowing outside the tubes thereof transmits heat to a second fluid flowing through the space between the concentric tubes.

2. Description of the Prior Art

Recuperative heat exchangers employing a series of concentric tubes are frequently used to transfer heat from hot combustion gases to cool air being supplied for combustion. The exhaust or waste gases are usually at extremely high temperatures when they enter the chamber of the heat exchanger in which the tubes are located and thus adversely affect the recuperator tubes and the housing in which they are supported. Moreover, differential expansion between tubes and housing structure damages any connection therebetween, so structural integrity of the heat exchanger is compromised and the heat exchanger is frequently forced to operate at less than maximum efficiency.

Examples of conventional heat exchange art are to be found in U.S. Pat. No. 3,586,098 and U.S. Pat. No. 2,670,945 where tube sheets supporting tubular heat exchangers are rigidly connected to inlet and outlet headers before being rigidly connected to surroundig housing structure. The temperature gradient inherent in devices of this type effects relative expansion and contraction of the several parts, and breakage of the weldments therebetween is common. Moreover, conventional heat exchangers of this type are excessively large and they frequently utilize extensive amounts of transverse ducting which may be extremely difficult to fit into exisiting space allotments.

SUMMARY OF THE INVENTION

The present invention relates to a heat exchanger of the concentric tube type wherein various parts thereof are pivotally mounted so they may thermally expand or contract without breaking a connecting bond therebetween. Moreover, the heat exchanger is comprised of adjacent modules having an integral ducting arrangement that precludes excess material requirements, reduces weight, and eliminates excessive external ducting. A plurality of modules is connected to permit serial flow of fluid therethrough, and the heat exchanger is designed to permit a maximum utilization of available heat.

Accordingly, the principle object of this invention is to provide a modular type tubular heat exchanger that is economical to manufacture, remains structurally sound throughout a wide range of temperature variations, and one which essentially eliminates external ducting.

Moreover, the elements of this heat exchanger are of modular construction that may be arranged serially to provide increased capacity, while ducting for the several fluids is adapted to provide maximum utilization of available heat.

BRIEF DESCRIPTION OF THE DRAWING

These and further advantages will be more completely disclosed and described in the following specification and the accompanying drawing in which.

DESCRIPTION OF THE PREFERRED EMBODIMENT

Figure 1:
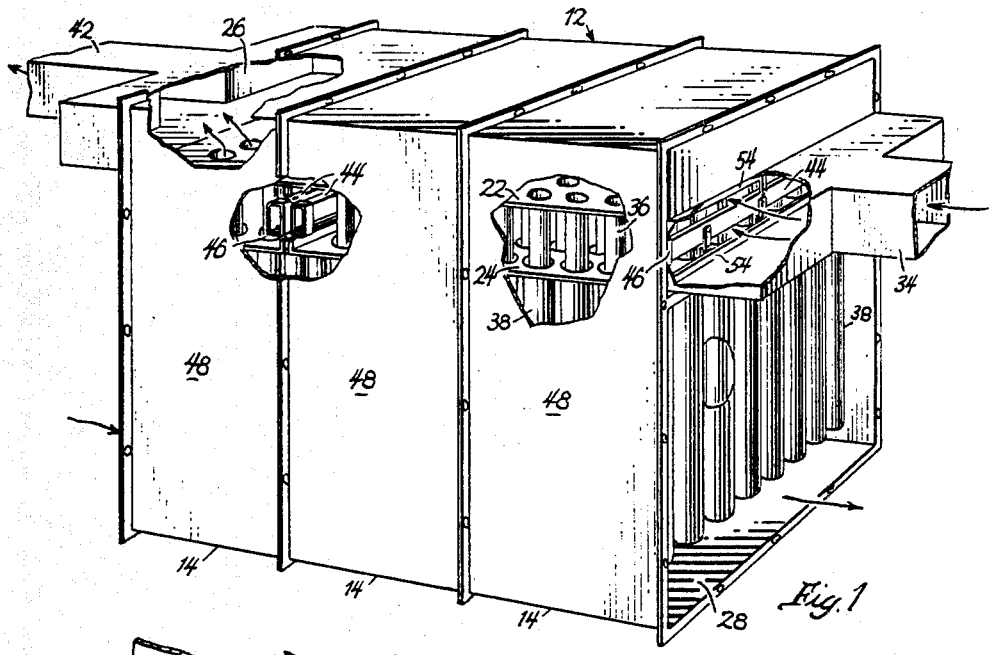
FIG. 1 is a perspective view, partially broken away to show a series of adjacent modules.
Figure 2:
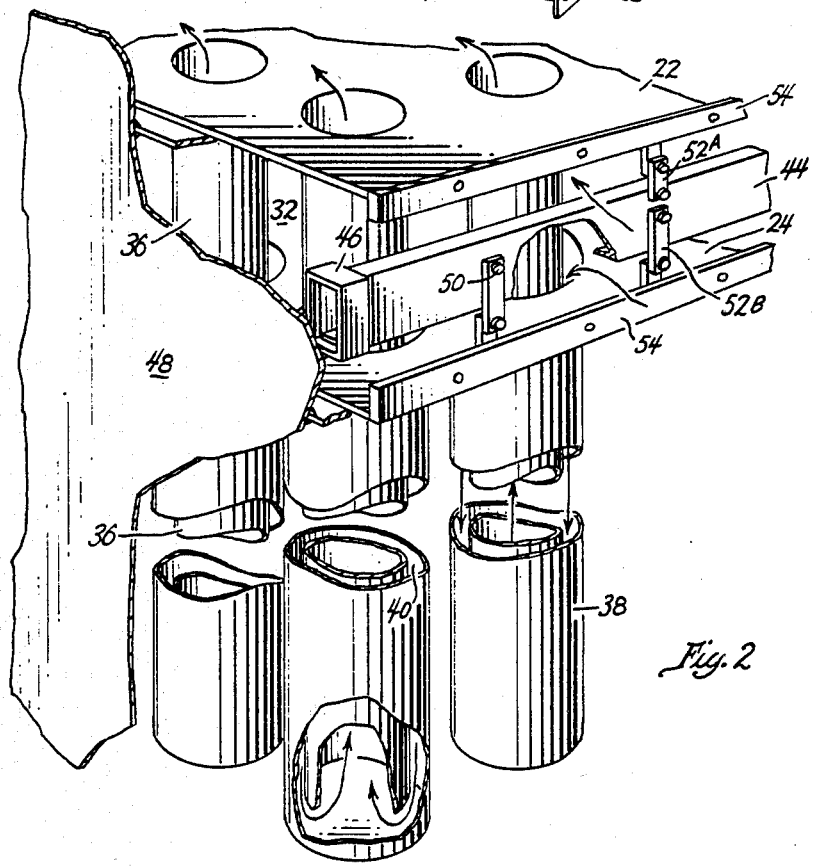
FIG. 2 is an enlarged perspective view showing the structural details of a single module.
Figure 3:
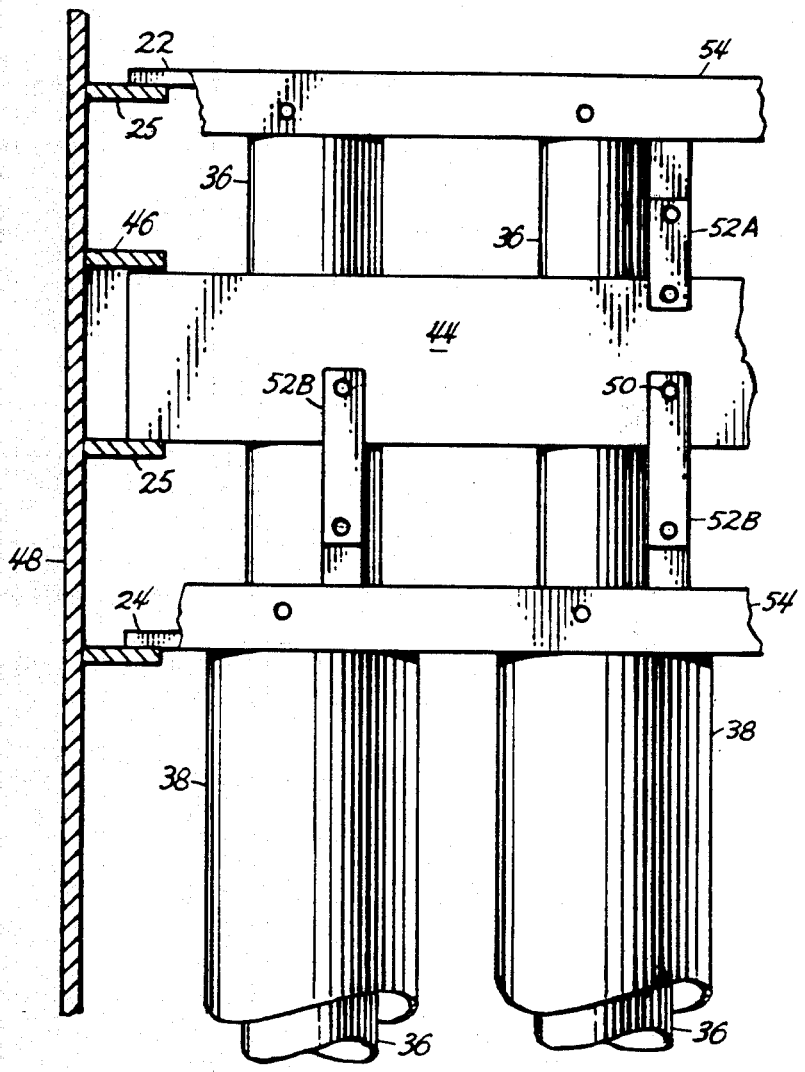
FIG. 3 is a side elevation of the device shown in FIG. 2.

Referring to FIG. 1 of the drawing, the numeral 12 generally refers to a recuperative type concentric tube heat exchanger that is comprised of a series of identical modules 14 supported in lateral juxtaposition and having the internal elements thereof supported so as to permit independent expansion of their several parts caused by inherent thermal differences.

Each module 14 includes a housing that encloses upper and lower tube sheets 22–24 that are spaced apart in with the ends of said sheets slidably abutting elongate flanges 25 carried by the housing walls to provide an upper compartment 26 above the tube sheets, a compartment 28 below the tube sheets, and a compartment 32 therebetween. The tube sheets 22–24 are provided with vertically aligned apertures, the apertures in the lower tube sheet 24 being somewhat larger than the apertures in upper sheet 22 whereby tubes 36 depending from the apertures of the upper tube sheet hang inside the tubes 38 that depend from the larger apertures of the lower tube sheet to provide an annular flow passageway 40 therebetween.

An inlet 34 is provided to admit a cool fluid to be heated to the space between tube sheets 22–24 whereby it will flow into the annular space between tubes in heat exchange relation with a heating fluid flowing through the lower compartment 28. After the cool fluid traversing annular passageway 40 reaches the closed end of the outer tube it is reversed to flow upwardly through inner tube 36 to the upper compartment 26 where an outlet duct 42 directs the heated fluid to its place of final use.

The cool inlet air of compartment 32 accordingly lies between the heating fluid traversing compartment 28 and the heated fluid of compartment 26 being exhausted through outlet port 42. Thus, cool fluid from inlet 34 in compartment 32 lies between the heating fluid of duct 28 and the heated fluid of duct 26 whereby said cool fluid is in a position to effectively absorb heat from hot fluids at either side thereof.

The tube sheets and dependent tubes of each module are supported from a pair of lateral beams 44 that lie at the sides of each module, the ends of the beams 44 in turn being supported by protrusion 46 that are connected to end panels 48 forming the outer housing of each module. The beams extend laterally across the inlet of each module to provide flow passageways above and below the beam 44 whereby each beam is subjected to the consistently lower temperature of the fluid to be heated and thus subject to a minimum of thermal deformation.

The basically stable transverse beams 44 are then used as a base to which the upper tube sheet 22 and the lower tube sheet 24 are pivotally secured. Flanges 54 at the end edges of the tube sheets are thus connected by links 52A and 52B to the beams 44 whereby any differential of expansion will be reflected in movement of the linkage means about connections 50.

Flanges 54 at the end edges of the tube sheets have apertures that permit bolting together of adjacent beams to increase the capacity of a given heat exchanger, while similar apertures in flanges around the end edges of panels 48 permit joining of adjacent units or the bolting in place of end plates that include passageways for the relatively hot and cold fluids. One end plate includes the inlet 34 for the fluid to be heated and an outlet for the hot fluid exhausting form compartment 28, while the opposite end plate includes an outlet 42 for the heated fluid and an inlet for hot fluid being directed into the compartment 28 and over the outside of tubes 38.

We claim:

1. A concentric tube recuperative heat exchanger that comprises a plurality of laterally adjacent modules arranged to permit serial flow therethrough of a heating fluid and a fluid to be heated, each of said modules comprising a housing that encloses parallel upper and lower tube sheets having aligned apertures therein, said tube sheets dividing each module into a lower compartment for a heating fluid, an upper compartment for a fluid that has been heated and an inlet compartment for cool fluid to be heated therebetween, outer tube means tightly embracing the apertures of the lower tube sheet having a closed end that depends downward therefrom into the compartment for the heating fluid, central tube means embracing an aperture of the upper tube sheet and extending therebetween, an inlet port in said housing adapted to admit a cool fluid to be heated to the inlet compartment and direct it down through the annular passageway and up through the central tube to the outlet compartment for the heated fluid, means admitting a heating fluid to the heat exchange compartment and directing it over the outer tube means in heat exchange relation with the fluid to be heated, and an elongate support beam extending laterally between housing walls intermediate said tube sheets adapted to support the tube sheets and the tube means depending therefrom.

2. A concentric tube recuperative heat exchanger as defined in claim 1 wherein an elongate flange lies at opposite sides of each module to slidably abut the tube sheets.

3. A concentric tube recuperative heat exchanger as defined in claim 2 wherein the elongate support beams include pivotal links that connect the elongate support beams to the upper and lower tube sheets to permit relative expansion therebetween.

4. A concentric tube recuperative heat exchanger as defined in claim 3 including a protrusion on the housing at each end of the support beam adapted to support said beam independent from the housing for relative movement therebetween.

5. A concentric tube recuperative heat exchanger as defined in claim 4 wherein the inlet port for the cool fluid to be heated lies adjacent said beam and directs cool inlet fluid over the support beam to subject said beam to even temperature of the inlet fluid to preclude excessive expansion thereof.

* * * * *

UNITED STATES PATENT AND TRADEMARK OFFICE

CERTIFICATE OF CORRECTION

PATENT NO. : 4,361,183

DATED : November 30, 1982

INVENTOR(S) : Jay T. Ware, Wayne S. Counterman, Milton C. Brown

It is certified that error appears in the above—identified patent and that said Letters Patent is hereby corrected as shown below:

Cover page, Item 73, Assignee should be changed from "Combustion Engineering, Inc., Windsor, Conn." to --The Air Preheater Company, Inc., Wellsville, New York--

Signed and Sealed this

*Nineteenth* Day of *April 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,361,183

DATED : November 30, 1982

INVENTOR(S) : Jay T. Ware et al

It is certified that error appears in the above—identified patent and that said Letters Patent is hereby corrected as shown below:

Column 1, line 30, change "surroundig" to --surrounding--

Column 2, line 19, after "in" insert --parallel planes-- line 51, change "protrusion" to --protrusions--

Column 3, line 26, after "extending" insert --coaxially inside the outer tube to provide an annular passageway--

Signed and Sealed this

Sixth Day of September 1983

[SEAL]

*Attest:*

GERALD J. MOSSINGHOFF

*Attesting Officer*

*Commissioner of Patents and Trademarks*